United States Patent [19]

Lepper

[11] Patent Number: 4,907,890

[45] Date of Patent: Mar. 13, 1990

[54] PORTABLE-CONCRETE MIXING DEVICE AND METHOD FOR USING SAME

[75] Inventor: Larry G. Lepper, Indianola, Iowa

[73] Assignee: Cemen-Tech, Inc., Indianola, Iowa

[21] Appl. No.: 200,581

[22] Filed: May 31, 1988

[51] Int. Cl.[4] ..... B28C 7/06; B28C 7/12; B28C 7/16; B28C 5/16

[52] U.S. Cl. ..... 366/27; 366/33; 366/40; 366/50

[58] Field of Search ..... 366/2, 6, 8, 16, 19, 366/21, 27, 28, 33, 34, 40, 41, 42, 50, 64, 67, 68, 17, 160, 162, 173, 182, 177, 172, 26; 222/81, 71, 132, 129, 134, 485

[56] References Cited

U.S. PATENT DOCUMENTS

| | | | |
|---|---|---|---|
| Re. 17,067 | 8/1928 | Ver Mehr | 366/26 X |
| 979,778 | 12/1910 | Malloy | 366/33 X |
| 1,502,352 | 7/1924 | Simonson | 222/485 X |
| 1,724,033 | 8/1929 | Lichtenberg | 366/19 X |
| 1,754,533 | 4/1930 | Van Kirk | 366/50 X |
| 2,139,027 | 12/1938 | McConnaughay | 366/50 X |
| 2,291,267 | 7/1942 | Weiner | 366/182 X |
| 2,319,720 | 5/1943 | Chesnut | 366/2 |
| 2,748,990 | 6/1956 | Kemper | 366/40 X |
| 2,948,519 | 8/1960 | Bradshaw, Jr. et al. | 366/16 |
| 2,976,025 | 3/1961 | Pro | 366/26 X |
| 3,184,112 | 5/1965 | Loeser | 222/132 X |
| 4,117,547 | 9/1978 | Mathis et al. | 366/17 |
| 4,285,598 | 8/1981 | Horton | 366/19 X |
| 4,406,548 | 9/1983 | Haws | 366/8 |
| 4,506,982 | 3/1985 | Smithers et al. | 366/19 |
| 4,585,353 | 4/1986 | Schonhausen | 366/50 X |
| 4,586,823 | 5/1986 | Schondorfer et al. | 366/64 X |
| 4,624,575 | 11/1986 | Lantz | 366/16 |

FOREIGN PATENT DOCUMENTS

| | | | |
|---|---|---|---|
| 1267615 | 5/1968 | Fed. Rep. of Germany | 222/81 |
| 2098497 | 11/1982 | United Kingdom | 366/64 |

*Primary Examiner*—Harvey C. Hornsby
*Assistant Examiner*—Scott J. Haugland
*Attorney, Agent, or Firm*—Zarley McKee, Thomte, Voorhees & Sease

[57] ABSTRACT

The portable continuous mixing device of the present invention comprises a first upper frame adapted to drop the dry concrete ingerdients into the upper end of a hopper. The ingredients drop out of the lower end of the hopper onto a second conveyor which deposits the dry ingredients into the input end of a continuous auger mixer. Water and admix are also added to the input end of the auger mixer and the mixer mixes all of these ingredients and discharges them from a discharge end.

8 Claims, 3 Drawing Sheets

PORTABLE-CONCRETE MIXING DEVICE AND METHOD FOR USING SAME

BACKGROUND OF THE INVENTION

This invention relates to a portable concrete mixing device and method for using same.

One problem encountered at various constructions sites is the ability to prepare relatively small amounts of mixed concrete for small jobs. An example of such a situation is the need for pouring concrete to patch various small sections of a highway or street. Large batch mix trucks which are usually used for large concrete pours are not convenient for small odd jobs required such as encountered in the patching of streets and highways.

It is also desirable to prepare the concrete mixture by a continuous process as opposed to a batch process. In the continuous process the ingredients are fed into an auger mixer which continuously mixes the ingredients so long as it is supplied with ingredients. This makes possible the preparation of the exact amount of concrete needed for a particular job, and the amount can be varied from one job to another.

This is to be contrasted with the batch mixing system often used at construction sites wherein a batch of concrete is mixed and delivered to the site by a truck. If the batch is too large for the job, the residue must be dumped and is not used. If the batch is too small then a second truck is required, and usually some residue is left from the second batch.

Therefore, a primary object to the present invention is the provision of an improved portable concrete mixing device and method for using same.

A further object of the present invention is the provision of a portable concrete mixing device which uses a continuous process of mixing so that exactly the needed amount of concrete can be prepared.

A further object of the present invention is the provision of a portable concrete mixing device which utilizes bags of premixed concrete to which water can be added for preparing the final mixture.

A further object of the present invention is the provision of a portable concrete mixing device which can be used for small pouring jobs and which can be transported by using a conventional truck or vehicle rather than a large ready mix concrete truck.

A further object of the present invention is the provision of a device which permits the adjustment of the water and concrete mixture to achieve the desired end result.

A further object of the present invention is the provision of a portable concrete mixing device which permits the addition of various admixes to the mixture during the time that it is being mixed.

A further object of the present invention is the provision of a device which is economical to manufacture, durable in use and efficient in operation.

SUMMARY OF THE INVENTION

The present invention comprises a trailer mounted continuous mixing unit designed to mix preblended materials such as sand, stone, and cement with water and admixtures. It can be used for concrete, but it can also be used for mixing such things as brick mortar. The unit is not designed to carry all the materials necessary to do a large pouring operation. It can be towed behind a vehicle such as a flat bed truck which will carry bags of the premixed material and additional supplies of water and admixtures.

The device includes a loading conveyor having a first hopper at the input and thereof. The bags of cement are emptied into the hopper and the first conveyor carries the mixture to a second hopper where it is deposited. At the lower end of the second hopper is a second conveyor which removes the materials therefrom and carries the materials to the input end of a continuous auger mixer.

The device also includes a water reservoir, and a conduit for carrying the water from the reservoir to the input end of the auger mixer. The water and the dry ingredients are mixed by the mixer and are discharged from the outlet end of the mixer. This mixing is continuous so long as the dry ingredients and the water are introduced to the input end of the mixer.

The device also includes at least one or two reservoirs for admixtures which can be added to the water and dry ingredients. The admixture reservoirs are connected to the input end of the auger mixer by conduits which have calibration indicators therein so that the velocity of flow of admixture can be ascertained visually.

A control system including three valves is provided for adjusting the flow of water and admixtures to the input end of the auger mixer.

A second control system controls the speed at which the conveyors operate. By adjusting the relative speeds of the conveyors and of the valves for the water and admixtures, it is possible to achieve any of a variety of desired mixtures needed for a particular job.

The device can be used to mix various odd sizes of concrete needed for various jobs such as patching or such as preparing various quantities of mortar at construction sites. The system eliminates waste since only the needed quantities of mixed concrete or mortar are prepared. This is to be contrasted with batch systems wherein the unused residue of mixture must be thrown away.

DETAILED DESCRIPTION OF THE PREFERRED EMBODIMENT

Figure 1:
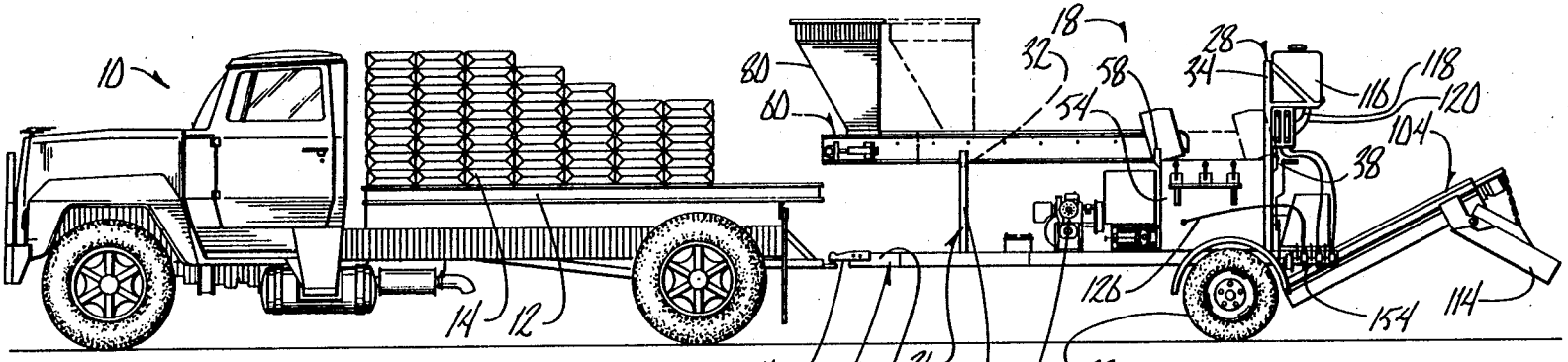
FIG. 1 is an elevational view of a flat bed truck behind which is pulled the mixing device of the present invention.

Referring to the drawings the numeral 10 generally designates a flat bed truck having a flat bed 12 for carrying a stack of bags 14 of premixed concrete or mortar. Bags of premix materials are commercially available and include the dry ingredients for mixing concrete or mortar, such as sand, aggregate, cement, etc. At the rear end of truck 10 is a conventional ball hitch 16.

Trailing behind vehicle 10 is the portable concrete mixing device 18 of the present invention. Device 18 includes a frame assembly 20 which is supported by ground engaging wheels 22 and which is attached to ball hitch 16 by a tongue and hitch assembly 24.

Extending upwardly from frame 20 adjacent the forward end thereof is a forward mast 26 and extending upwardly from frame 20 at the rearward end thereof is a rearward mast 28. Forward mast 26 comprises two spaced apart upstanding members 30. Rearward mast 28 similarly includes a pair of upstanding members 34 which support an admix shelf 36 at their upper ends. A second roller 38 extends between upstanding members 34 at the same vertical level as roller 32 of forward mast 28.

Figure 3:
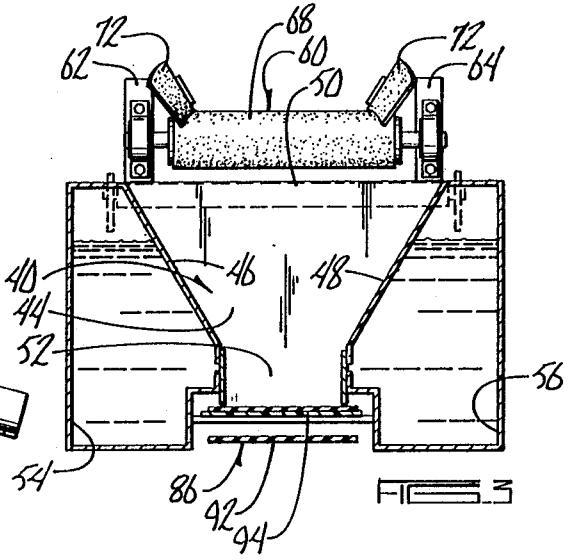
FIG. 3 is a sectional view taken along line 3—3 of FIG. 2.

Also, rigidly supported above frame assembly 20 is a mixer hopper 40 having a forward wall 42, a rear wall 44, and two opposite angled side walls 46, 48 (FIG. 3). Hopper 40 includes an open upper end 50 and an open lower end 52 which is smaller then upper end 50 by virtue of the tapered configuration of walls 48.

As can be seen in FIG. 3, walls 46, 48 comprise part of two water tanks 54,56 which are on opposite sides of hopper 40. A third roller 58 is rotatably mounted adjacent the upper edge of front wall 44 of hopper 40, and is positioned on the same level as rollers 32, 38.

A first conveyor assembly 60 is supported on rollers 32, 58, 38 and is adapted to move from the position shown in solid lines in FIG. 1 to the position shown in shadow lines in FIG. 1. Conveyor assembly 60 comprises a pair of spaced apart frame members 62, 64 which support a pair of spaced apart conveyor rollers 66 around which is trained a conveyor belt 68. A slide plate 70 is positioned beneath the upper most portion of belt 68 and provides support thereto. On opposite sides of the upper portion of conveyor belt 68 are a pair of flexible flashing members 72, 74. Mounted on frame members 62 at the forward end thereof is an extensible hydraulic cylinder 74 which is fixed to side frame member 62 and which includes a rod 76 attached to a shaft 78 which rotatably supports one of the conveyor rollers 66 (not shown) at the forward end of first conveyor assembly 60. Cylinder 74 permits the tensioning of the conveyor belt 68 to the desired tension.

During transporting the conveyor assembly 60 is moved rearwardly on rollers 32, 58, 38 to its extreme rearward position and is secured by chains or other suitable means in that position for transporting. When the device reaches the construction site the conveyor assembly 60 is moved forwardly to the position shown in solid lines in FIG. 1.

At the forward end of conveyor assembly 60 is a second hopper 80 which has open upper end 82 and an open lower end 84 adjacent conveyor belt 60. The upper end of hopper 82 is provided with a breaker bar 87 against which the bags 14 can be broken so as to permit the contents of the bags to be dumped into hopper 80.

Figure 2:
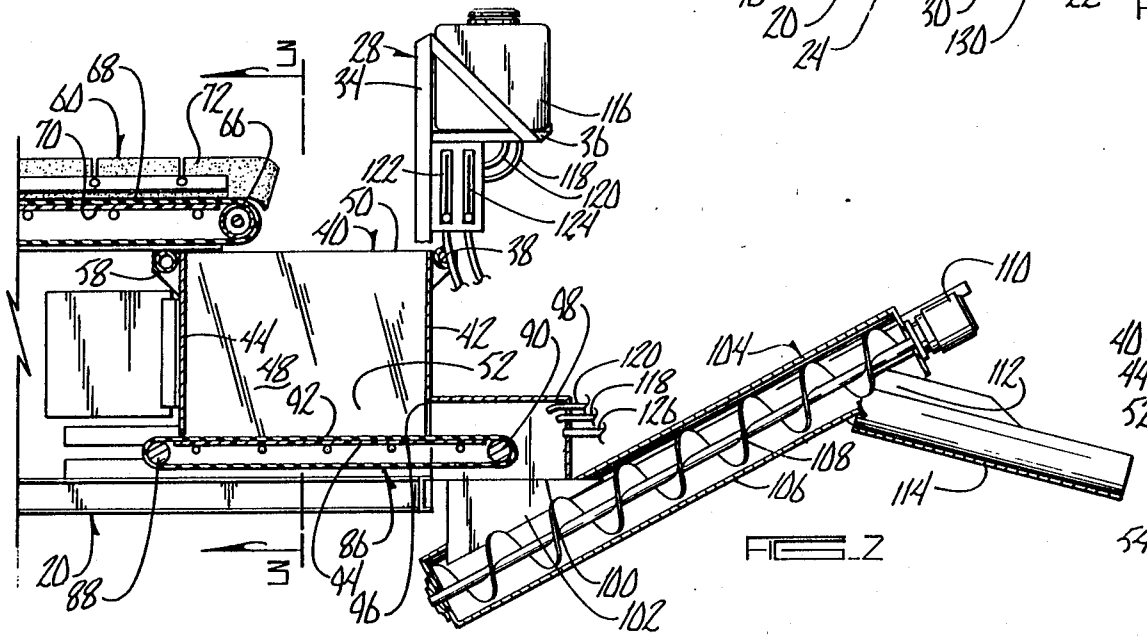
FIG. 2 is a sectional view showing the internal workings of the device.
Figure 4:
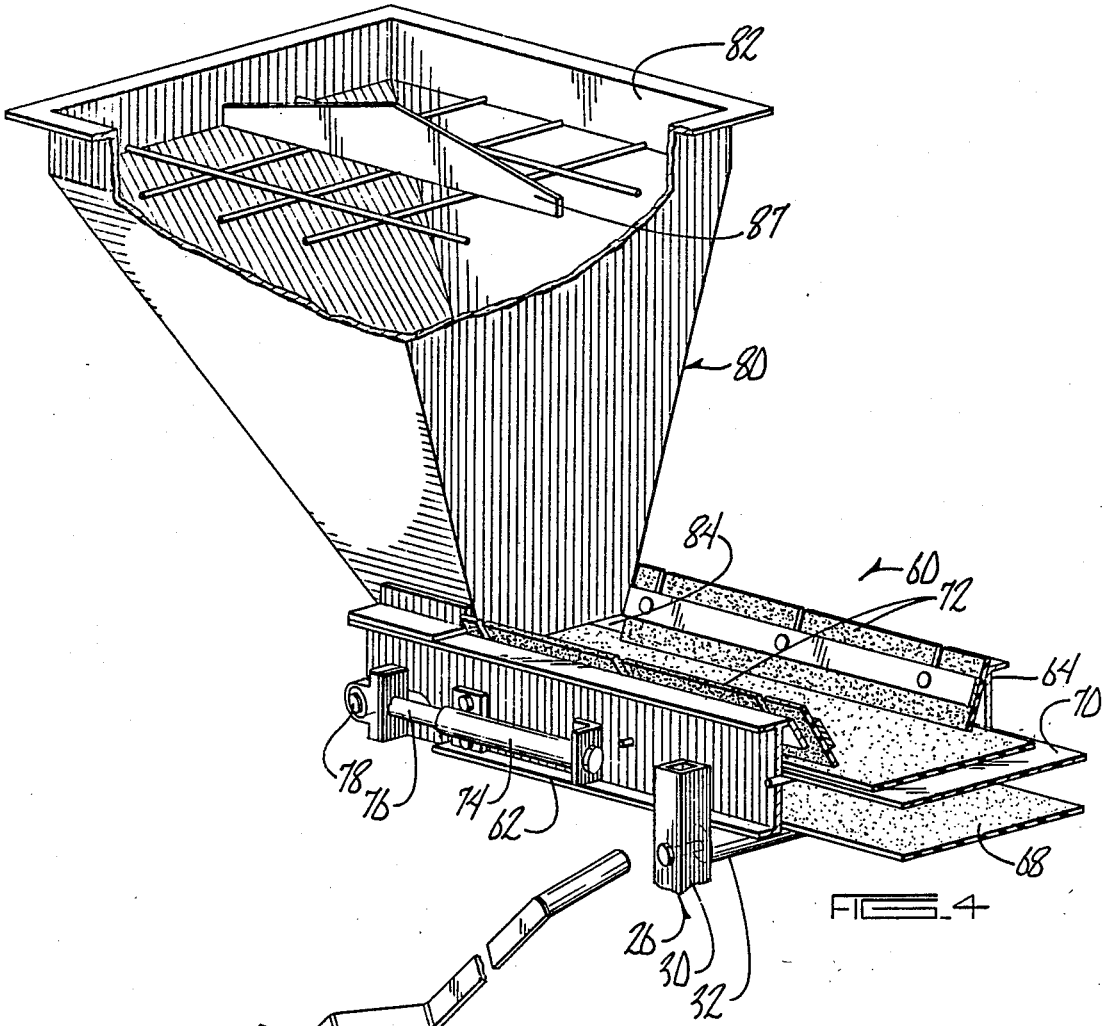
FIG. 4 is an enlarged detail view of the first hopper of the present invention.

Referring to FIGS. 2 and 3, a second conveyor assembly 86 is mounted beneath the lower most edge of mixer hopper 40. Conveyor assembly 86 comprises a pair of spaced apart conveyor rollers 88, 90 around which is trained a conveyor belt 92 which in turn is supported by a slide plate 94.

It should be noted that the front wall 42 of hopper 40 terminates in a lower edge 96 which is spaced upwardly a predetermined distance above conveyor belt 92. This permits the lower edge 96 to function as a weir to limit the amount of mixture conveyed by conveyor belt 92 towards roller 90. Roller 90 are located within a mixer box 98 having an open lower end 100. Thus, ingredients being carried by conveyor belt 92 toward roller 90 is permitted to fall downwardly and outwardly through open lower end 100 into the input end 102 of an auger mixer 104. Auger mixer 104 includes a cylindrical tube 106 in which is rotatably mounted an auger 108 which is rotated by an auger motor 110. At the opposite end of auger mixer 104 from input end 102 is a discharge opening 112 under which is mounted a discharge spout 114. Thus, ingredients falling into input end 102 are conveyed and mixed by auger 108 to the point where they are discharged from outlet opening 112 into discharge chute 114.

Mounted on admix shelf 36 are one or more admix reservoirs 116 which contain a liquid admix material for adding to the concrete mixture. Extending downwardly from two admix reservoirs 116 (only one is shown in profile) are a pair of conveyor tubes 118, 120 which are connected to calibration gauges 122, 124, respectively, and which continue downwardly into mixer box 98. Thus, the contents of admix containers 116 are discharged into mixer box 98 and are permitted to fall into the input end 102 of auger mixer 104 for mixing with the other ingredients. Similarly, a water tube 126 extends from water tanks 54, 56 to the mixer box 98 so that the water can be discharged into the input end of auger mixer 104 with the other ingredients.

Figure 6:
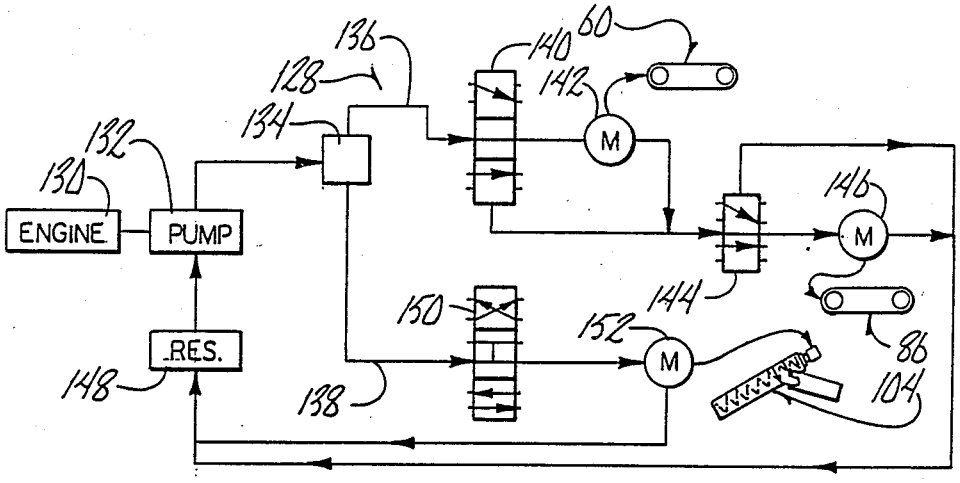
FIG. 6 is a schematic view of the hydraulics circuitry of the present invention.

Referring to FIG. 6 a control system is generally designated by the numeral 128, and s shown schematically. System 128 is a hydraulic system adapted to drive first conveyor assembly 60, second conveyor assembly 86, and auger mixer 104. System 128 includes an engine 130 which drives a hydraulic pump 132. Pump 32 is in turn connected to a flow divider 134 which divides the hydraulic circuitry into a first portion 136 for driving conveyors 60, 86, and a second circuit portion 138 for driving auger mixer 104. A three way valve 140 is connected to a hydraulic motor 142 which drives first conveyor 60. Valve 140 is also connected to a second three way valve 144 which drives a hydraulic motor 146 for operating second conveyor assembly 86. Circuit 136 then directs the hydraulic fluid back to reservoir 148. The second portion 138 of the hydraulic circuit includes a three way valve 150 which is in connection with a hydraulic motor 152 for driving auger mixer 104. Valves 140, 144, and 150 are adjustable so as to adjust the relative speeds of the motors 142, 146, 152, respectively. This permits the selective adjustment of the speed at which the various conveyors go relative to one another, thereby permitting the adjustment of the mixture ratios of the ingredients being mixed in the auger mixer 104.

Figure 5:
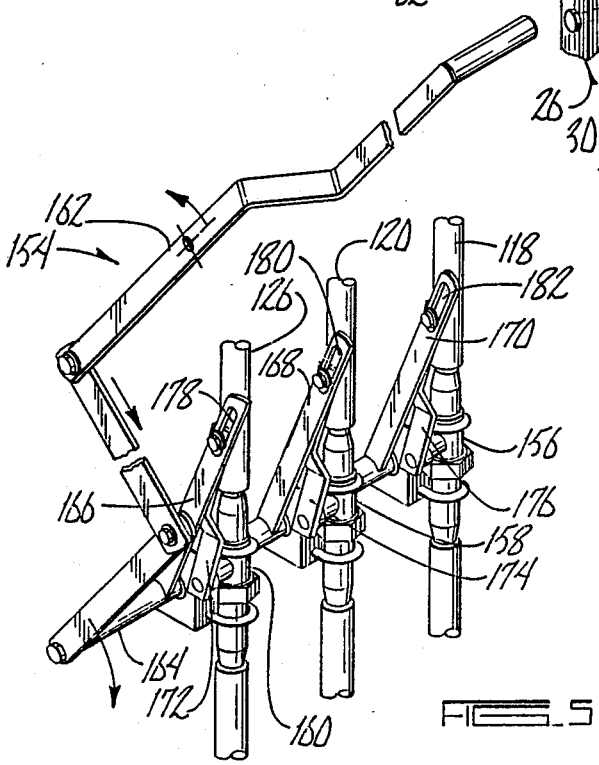
FIG. 5 is an enlarged perspective view of the valving system for the water and admixtures.

Similarly, the amounts of water and admixture added to the ingredients can be adjusted by virtue of a valving system 154 shown in FIG. 5. System 154 includes first, second and third valves 156, 158, and 160 which are in turn connected to admix tubes 118, 120 and water tube 126, respectively. A lever 162 is connected by a shaft 164, to a plurality of first links 166, 168, 170. Links 166, 168, 170 are in turn connected to valve arms 172, 174, 176 which in turn are connected to and control valves 160, 158, and 156, respectively. The rotation of lever 162 causes all three valves 160, 158, 156 to be either opened or closed simultaneously. Adjustments in the extent to which the valves 160, 158, 156 are opened can be made by virtue of the slots 178, 180, 182 in links 166, 168, 70, respectively. By making these adjustments it is possible to obtain the proper ratios of mixtures of the two admixtures coming from tubes 118, 120 and the water coming from tube 126.

In operation the vehicle 10 is used to pull the trailer mixing device 18 to the desired location. When concrete is needed, the bags 14 are broken over breaker bar 87 of hopper 80. The bags 14 contain the desired dry mixture of ingredients for the particular job. For example, if concrete is being mixed the bag will include the appropriate amount of cement and aggregate. If mortar is being mixed the bag will include the appropriate mixture of cement and sand. The dry ingredients are permitted to fall down into hopper 80 and to be deposited on the conveyor belt 68 of first conveyor 60. Belt 68 then deposits the dry ingredients into the upper end of hopper 40 where the ingredients are permitted to fall down into the lower end of the hopper. The conveyor belt 92 of the second conveyor 86 then carries the dry ingredients into mixer box 98. The lower edge 96 of wall 42 of hopper 40 acts as a weir to limit the amount of dry ingredients that are carried to the mixer box 98. The dry ingredients are then dropped into the open input end 102 of the auger mixer 104.

At the same time the water tube 126 carries water from water tank 54 to the mixer box 98. Admix tubes 118, 120 carry the appropriate amount of admix (usually in a liquid form) to the box 98 also. The amounts of admix and water are controlled by the various settings of the valves 160, 158 and 156. Thus, the dry ingredients and the water and admix ingredients are added continuously and simultaneously to the input end 102 of auger mixer 104 which in turn is rotated by motor 110 to mix the materials and propel them outwardly through the outlet opening 112. The mixing can continue continuously until the desired amount of concrete or mortar has been mixed. As can be seen from the foregoing description, it is possible to mix the precise amount of concrete or mortar so that there is little or no waste. Furthermore, the ratios of the various ingredients can be adjusted by setting the appropriate settings on valves 156, 158, 160 and by adjusting the relative speeds of first conveyor 60 and second conveyor 86. Thus, it can be seen that the device accomplishes at least all of its stated objectives.

What is claimed is:

1. A portable concrete mixing device for trailing behind a powered vehicle comprising:

a portable frame having ground engaging wheels mounted thereon and having a forward end, a rear end, and first and second opposite sides, said portable frame having hitch means at said forward end thereof for detachably connecting said frame to said powered vehicle;

first and second spaced apart hopper means on said frame adjacent said forward and rearwards ends thereof respectively, each of said first and second hopper means having an open upper hopper end and an open lower hopper end;

first conveyor means on said frame having a first end adjacent and below said lower end of said first hopper means and having a second end adjacent and above said upper hopper end of said second hopper means for conveying dry concrete ingredients from said first hopper means to said second hopper means;

second conveyor means on said frame having first and second ends, said first end of said second conveyor means being below said lower hopper end of said second hopper means for receiving said concrete ingredients from said second hopper means and carrying said ingredients away from said second hopper means to said second end of said second conveyor means;

auger mixer means having an input end adjacent said second end of said second conveyor means for receiving said dry ingredients therefrom and having an output end, said auger mixer means having a rotatable auger means for continuously mixing said ingredients and for conveying said ingredients to and discharging said ingredients from said output end;

a water source on said portable frame;

water conveyor means for conveying water from said water source to said input end of said auger mixer means whereby said auger mixer means will mix said water with said dry ingredients;

a source of first admix ingredient on said portable frame;

a first admix conveyor for conveying said first admix ingredient to said input end of said auger mixer means for mixing with said water and said dry ingredients;

a source of second admix ingredient on said portable frame;

a second admix conveyor for conveying said second admix ingredient to said input end of said auger mixer means for mixing with said water and said dry ingredients.

2. A mixing device according to claim 1 comprising first and second admix control means associated with said first and second admix conveyors respectively for controlling the speed at which first and second admix conveyors deliver said first and second admix ingredients to said auger mixer means.

3. A mixing device according to claim 2 comprising a second conveyor control means for controlling the speed at which said second conveyor means delivers said dry ingredients to said auger mixer means.

4. A mixing device according to claim 3 wherein said second hopper means comprises an upstanding wall having a lower edge spaced a predetermined height above said second conveyor means, said wall being located between said dry ingredients within said second hopper means and said second end of said second conveyor means whereby said lower edge of said upstanding wall acts as a weir which limits the rate at which said second conveyor means carries said dry ingredients from said second hopper means to said auger mixer means.

5. A mixing device according to claim 1, wherein said first conveyor means comprises a pair of spaced apart conveyor rollers and a continuous conveyor belt trained around said rollers.

6. A mixing device according to claim 1 and further comprising first, second, and third power means for driving said first conveyor means, said second conveyor means, and said auger mixer means, respectively, a control system connected to said first, second, and third power means and comprising first, second, and third independent variable control means for permitting independent selective control of the speed at which said first, second, and third power means respectively drive said first conveyor means, said second conveyor means, and said auger mixer means, respectively.

7. A portable concrete mixing device for trailing behind a powered vehicle comprising:

a portable frame having ground engaging wheels mounted thereon and having a forward end, a rear end, and first and second opposite sides, said portable frame having hitch means at said forward end thereof for detachably connecting said frame to said powered vehicle;

first and second spaced apart hopper means on said frame adjacent said forward and rearward ends thereof respectively, each of said first and second hopper means having an open upper hopper end and an open lower hopper end;

first conveyor means on said frame having a first end adjacent and below said lower end of said first hopper means and having a second end adjacent and above said upper hopper end of said second hopper means for conveying dry concrete ingredients from said first hopper means to said second hopper means;

second conveyor means on said frame having first and second ends, said first end of said second conveyor means being below said lower hopper end of said second hopper means for receiving said concrete ingredients from said second hopper means and carrying said ingredients away from said second hopper means to said second end of said second conveyor means;

auger mixer means having an input end adjacent said second end of said second conveyor means for receiving said dry ingredients therefrom and having an output end, said auger mixer means having a rotatable auger means for continuously mixing said ingredients and for conveying said ingredients to and discharging said ingredients from said output end;

a water source on said portable frame;

water conveyor means for conveying water from said water source to said input end of said auger mixer means whereby said auger mixer means will mix said water with said dry ingredients;

said first conveyor means being movably mounted to said frame for movement in a forward direction from a retracted position toward an extended position, wherein said first end of said first conveyor means is above and adjacent said hitch means.

8. A mixing device according to claim 7, wherein said first hopper means is movable in unison with said first conveyor means when said first conveyor means moves from said retracted to said extended position.

* * * * *